US010190352B2

(12) United States Patent
Imaoka

(10) Patent No.: US 10,190,352 B2
(45) Date of Patent: Jan. 29, 2019

(54) WINDOW REGULATOR

(71) Applicant: HI-LEX CORPORATION, Hyogo (JP)

(72) Inventor: Takayuki Imaoka, Tochigi (JP)

(73) Assignee: HI-LEX CORPORATION, Hyogo (JP)

( * ) Notice: Subject to any disclaimer, the term of this patent is extended or adjusted under 35 U.S.C. 154(b) by 0 days.

(21) Appl. No.: 15/567,781

(22) PCT Filed: Apr. 21, 2016

(86) PCT No.: PCT/JP2016/062594
§ 371 (c)(1),
(2) Date: Oct. 19, 2017

(87) PCT Pub. No.: WO2016/171200
PCT Pub. Date: Oct. 27, 2016

(65) Prior Publication Data

US 2018/0112451 A1 Apr. 26, 2018

(30) Foreign Application Priority Data

Apr. 21, 2015 (JP) ..... 2015-086653

(51) Int. Cl.
*E05F 11/48* (2006.01)
*E05D 15/16* (2006.01)
*E05F 15/689* (2015.01)

(52) U.S. Cl.
CPC ..... *E05F 11/483* (2013.01); *E05D 15/165* (2013.01); *E05F 15/689* (2015.01); *E05Y 2201/66* (2013.01); *E05Y 2900/55* (2013.01)

(58) Field of Classification Search
CPC .... E05F 11/483; E05D 15/165; E05D 15/689; E05Y 2900/55; E05Y 2201/66
(Continued)

(56) References Cited

U.S. PATENT DOCUMENTS 5,505,022 A * 4/1996 Shibata ..... E05F 11/481 49/349
5,799,441 A * 9/1998 Shibata ..... E05F 11/481 49/352
(Continued)

FOREIGN PATENT DOCUMENTS

JP 02-089184 U 7/1990
JP 07305564 A * 11/1995 ..... E05F 11/481
(Continued)

OTHER PUBLICATIONS

International Search Report from International Application No. PCT/JP2016/062594 dated Jun. 21, 2016.

*Primary Examiner* — Jerry E Redman
(74) *Attorney, Agent, or Firm* — Brundidge & Stanger, P.C.

(57) ABSTRACT

This window regulator 1 is provided with a guide rail 31, a carrier plate 32, an ascending-side cable 33, and a descending-side cable 34. The carrier plate 32 has an ascending-side end holder 79 that houses an end 33*a* of the ascending-side cable 33, and a descending-side end holder 71 that houses an end 34*a* of the descending-side cable 34. The ascending-side end holder 79 is provided such that the ascending-side cable 33 is outside the guide rail 31. The descending-side end holder 81 is provided such that the descending-side cable 34 is on the guide rail 31. When the carrier plate 32 ascends and descends, the carrier plate 32 ascends and descends along the edges of the guide rail 31. Therefore, in the window regulator, abnormal noise can be suppressed.

3 Claims, 12 Drawing Sheets

(58) Field of Classification Search
USPC ..... 49/352
See application file for complete search history.

(56) References Cited

U.S. PATENT DOCUMENTS

| | | | | |
|---|---|---|---|---|
| 7,765,739 | B2 * | 8/2010 | Munezane | E05F 11/483 49/349 |
| 8,671,621 | B2 * | 3/2014 | Yoshida | E05F 11/486 49/352 |
| 8,881,457 | B2 * | 11/2014 | Matsushita | E05F 11/483 49/352 |
| 9,255,433 | B2 * | 2/2016 | Imaoka | E05F 11/486 |
| 2003/0101654 | A1 * | 6/2003 | Dufour | E05F 11/486 49/352 |
| 2004/0065018 | A1 * | 4/2004 | Regnier | E05F 11/485 49/352 |
| 2007/0044382 | A1 * | 3/2007 | Moriyama | E05F 15/689 49/352 |
| 2007/0251148 | A1 * | 11/2007 | Watson | E05F 11/485 49/352 |
| 2013/0133265 | A1 * | 5/2013 | Seo | E05F 15/00 49/352 |
| 2014/0109481 | A1 * | 4/2014 | Umemura | E05F 11/483 49/352 |
| 2015/0101252 | A1 * | 4/2015 | Baba | E05F 11/486 49/349 |
| 2017/0314307 | A1 * | 11/2017 | Imaoka | E05D 15/165 |

FOREIGN PATENT DOCUMENTS

| | | | | |
|---|---|---|---|---|
| JP | 2014-177838 | A | 9/2014 | |
| JP | 2015-048605 | A | 3/2015 | |
| JP | 2016204944 | A * | 12/2016 | E05F 11/48 |
| WO | WO-2014163103 | A1 * | 10/2014 | E05F 15/689 |

* cited by examiner

WINDOW REGULATOR

TECHNICAL FIELD

The present invention relates to a cable-type window regulator which drives a window glass of an automobile door up and down.

BACKGROUND ART

Window regulators are used for raising and lowering window glasses mounted in automobile doors. The window regulator includes: a carrier plate which holds a window glass; a guide rail which guides the carrier plate; and a raising and lowering cable for ascending and descending the carrier plate. A drive motor rotationally drives a drum to wind or unwind the raising and lowering cable, and thereby, the carrier plate is ascended or descended to ascend or descend the window glass.

The raising and lowering cable includes a raising-side cable and a lowering-side cable. The raising-side cable extends downward from a cable guide and includes a raising-side cable end which is engaged with a carrier end. The lowering-side cable extends upward from the drum and includes a lowering-side cable end which is engaged with the carrier plate (see, Patent Literature (hereinafter, referred to as "PTL") 1).

CITATION LIST

Patent Literature

PTL 1
Japanese Patent Application Laid-Open No. 2014-177838

SUMMARY OF INVENTION

Technical Problem

In terms of promoting weight reduction, the width of guide rails have been reduced as compared with the past. Accordingly, in the window regulator described in PTL 1, two cable-end housing sections of the carrier plate are disposed respectively on outer sides spaced from the guide rail in planar view; in other words, the two cable-end housing sections are disposed outside a width region of the guide rail. In a window regulator having such a configuration, there is a problem in that noise occurs, for example, when the carrier plate and the window glass move up.

It is therefore an object of the present invention to suppress noise occurring when a carrier plate moves up in a window regulator.

Solution to Problem

Hereinafter, a description will be given of a plurality of aspects as means for solving the problem. These aspects can be optionally combined as appropriate.

A window regulator according to an aspect of the present invention includes a guide rail, a carrier plate, a raising-side cable, and a lowering-side cable.

The carrier plate includes: a raising-side end holder which houses an end of the raising-side cable; and a lowering-side end holder which houses an end of the lowering-side cable.

The raising-side end holder is provided such that the raising-side cable is positioned outside the guide rail.

The lowering-side end holder is provided such that the lowering-side cable is positioned on or above the guide rail.

The carrier plate is configured to move up and down along an edge of the guide rail when the carrier plate moves up and down.

In this window regulator, since the lowering-side cable is disposed on or above the guide rail, the lowering-side cable easily slides with the guide rail when the carrier plate moves up and the lowering-side cable is unwound. Thus, noise caused by vibration of the lowering-side cable is suppressed.

In a structure where a lowering-side cable is also disposed laterally apart from a guide rail as in the related art, because a load on the lowering-side cable is reduced, the lowering-side cable is in a state capable of vibrating when a carrier plate moves up. Accordingly, the lowering-side cable easily vibrates when external vibration is applied in this state in this structure. For this reason, the window regulator according to the aspect of the present invention can solve the problem in the related art as described above.

The lowering-side cable is in contact with the guide rail when the carrier plate is at least in an upper-end restraint position with respect to the guide rail.

In this window regulator, the lowering-side cable is in contact with the guide rail when the carrier plate is at least near the upper-end restraint position. Thus, noise caused by the vibration of the lowering-side cable can be effectively suppressed. This is because the lowering-side cable is most unwound in length when the carrier plate is near the upper-end restraint position, and thus, the lowering-side cable easily vibrates.

The window regulator may further include a cable hooking member on which the lowering-side cable member is to be wound. In this case, the guild rail has a width smaller than an outer diameter of the cable hooking member.

In this window regulator, since the guild rail has a width smaller than an outer diameter of the cable hooking member, weight reduction of the guide rail becomes a reality.

A lead-out section of the lowering-side cable in the cable hooking member may be positioned on or above the guide rail. In this window regulator, since the lead-out section of the lowering-side cable is positioned on or above the guide rail, the lowering-side cable can be surely disposed on or above the guide rail even in a case where the width of the guide rail is smaller than the outer diameter of the cable hooking member.

Advantageous Effects of Invention

In a window regulator according to the present invention, noise occurring when a carrier plate moves up can be suppressed.

DESCRIPTION OF EMBODIMENTS (1) Window Regulator

Figure 1:
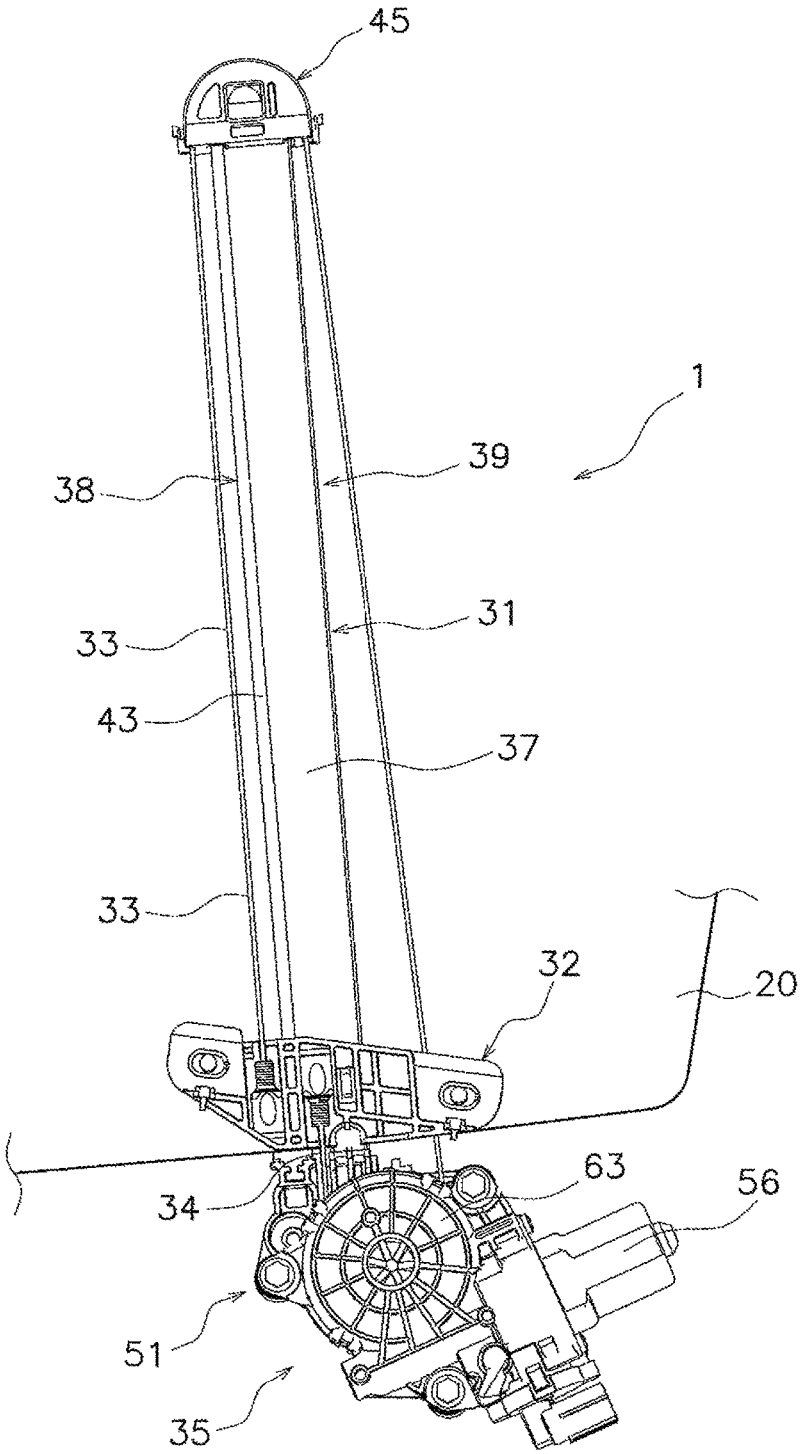
FIG. 1 is a front view of a window regulator as an embodiment of the present invention (carrier plate is in a lower position)
Figure 2:
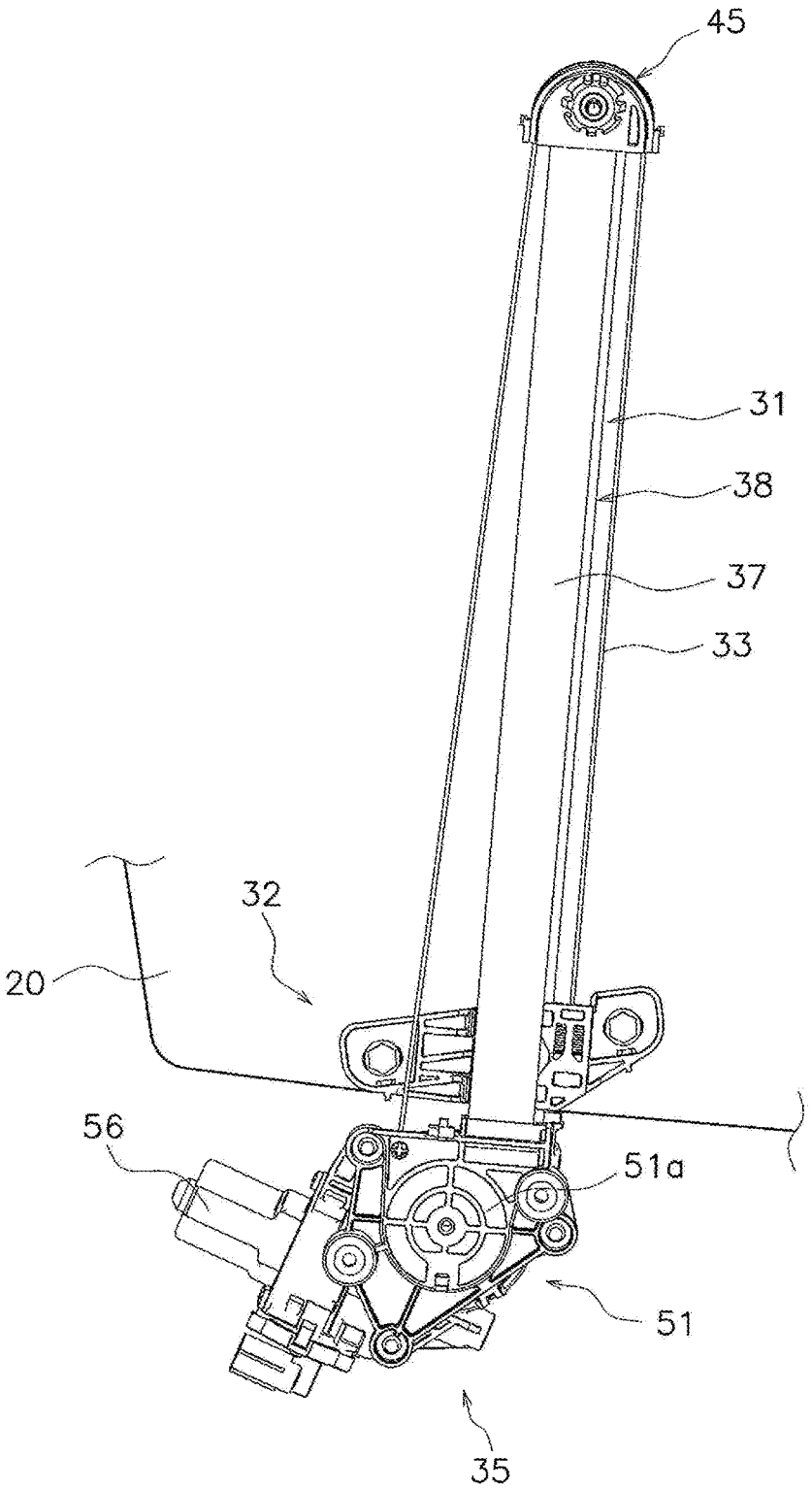
FIG. 2 is a rear view of the window regulator (carrier plate is in a lower position)
Figure 3:
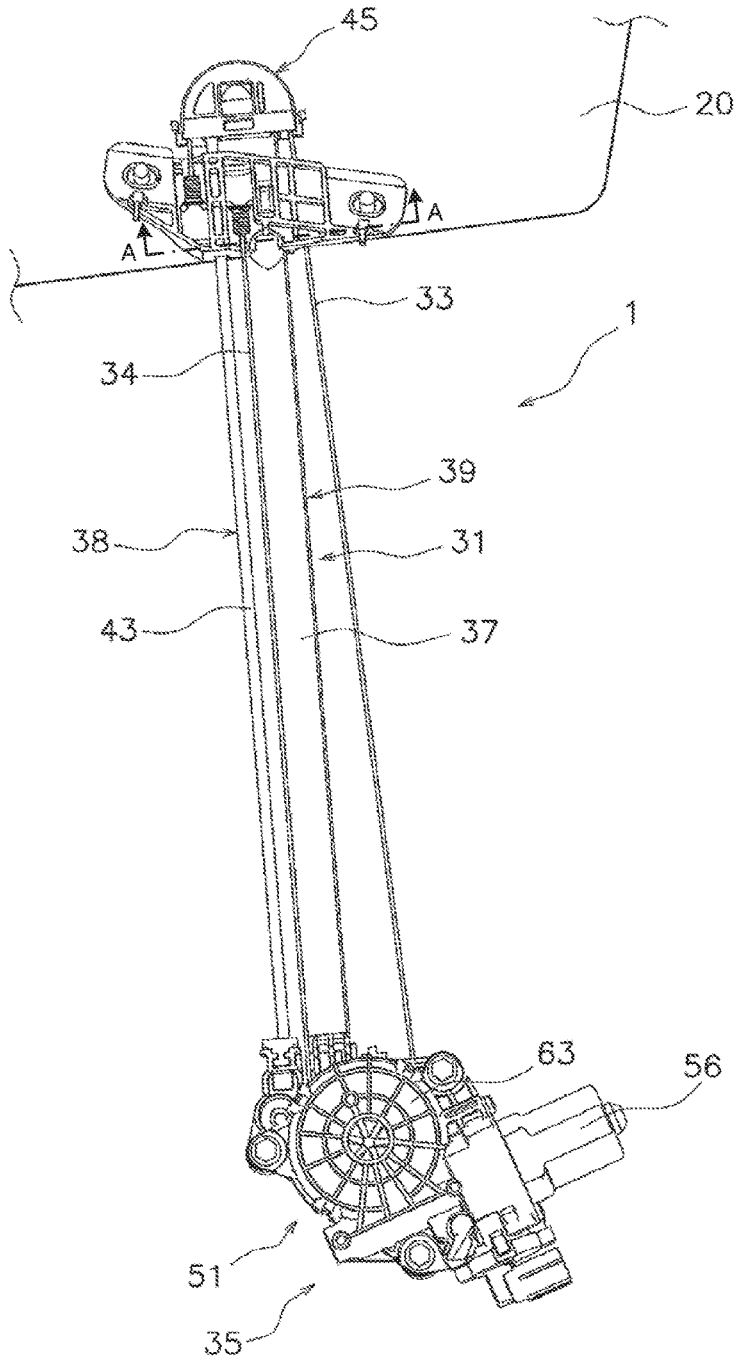
FIG. 3 is a front view of the window regulator (carrier plate is in an upper position)
Figure 4:
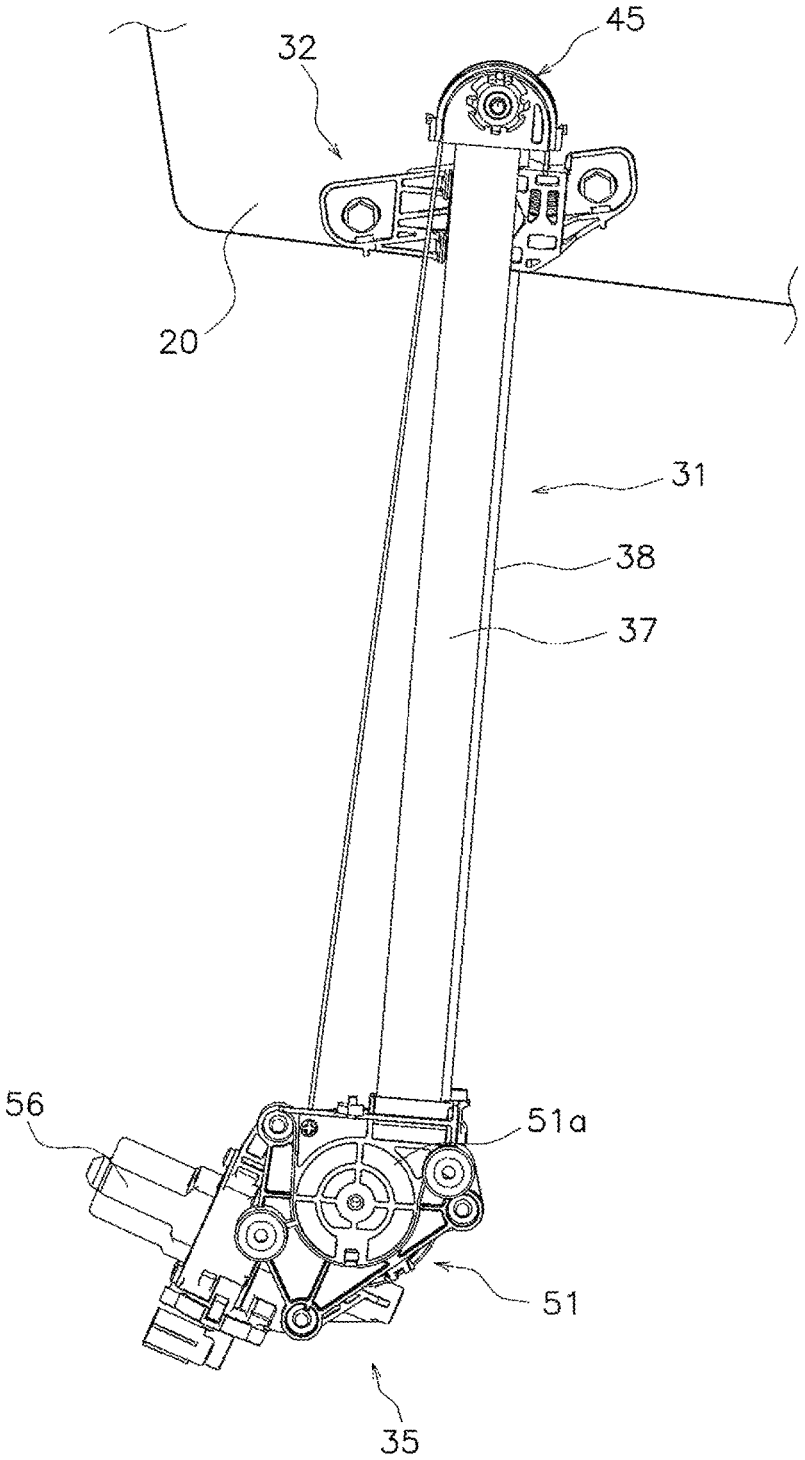
FIG. 4 is a rear view of the window regulator (carrier plate is in an upper position)
Figure 5:
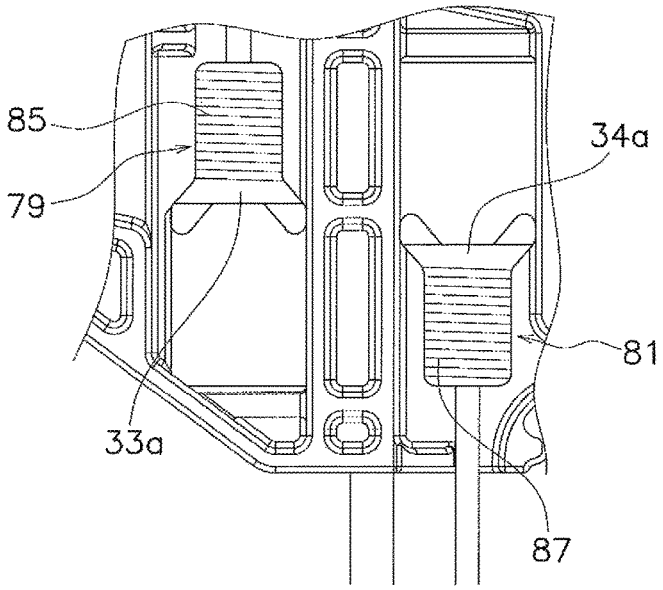
FIG. 5 is a front view of a carrier plate (carrier plate is in a middle position)
Figure 6:
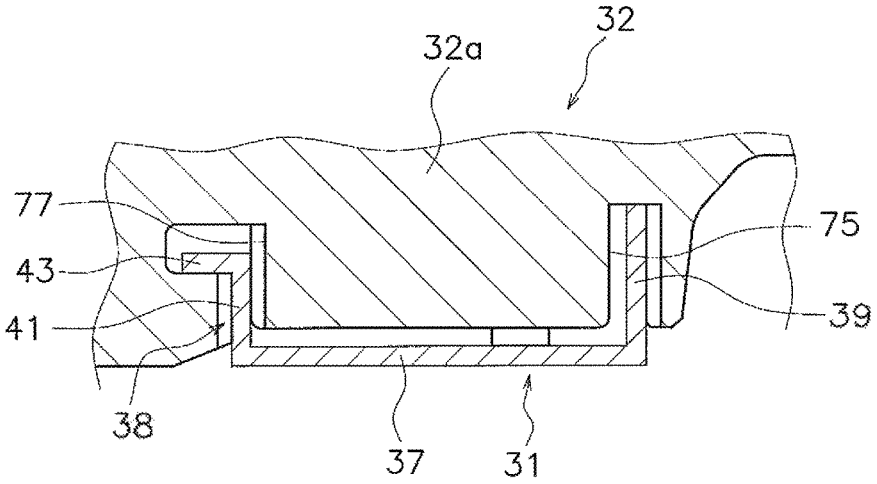
FIG. 6 is a partial cross-sectional view of the carrier plate and a guide rail along the line A-A shown in FIG. 3.

Window regulator 1 as an embodiment according to the present invention will be described using FIGS. 1 to 5. FIGS. 1 and 3 are front views illustrating an embodiment of a window regulator, and FIGS. 2 and 4 are rear views of the window regulator. FIG. 5 is a front view of a carrier plate. FIG. 6 is a partial cross-sectional view of the carrier plate and a guide rail. Note that, a description will be hereinafter given based on an assumption that the front view of window regulator 1 is a diagram illustrating a case where window regulator 1 is in planar view.

Window regulator 1 is a mechanism which causes window glass 20 to move up and down. Window glass 20 is supported by a door panel of a vehicle (not illustrated) in a vertically movable manner. Window regulator 1 mainly includes guide rail 31, carrier plate 32, raising-side cable 33, lowering-side cable 34, and drive section 35.

Guide rail 31 is a member which is provided along an up-down direction of window glass 20 and configured to guide carrier plate 32 in the up-down direction of window glass 20. A structure of guide rail 31 will be described in detail, later.

Carrier plate 32 is a member configured to hold a lower end portion of window glass 20 and to be engaged with guide rail 31 and slidingly guided in the up-down direction of window glass 20. Carrier plate 32 moves up and down along an edge of guide rail 31. A structure of carrier plate 32 will be described in detail, hereinafter.

As illustrated in FIGS. 1 to 4, upper cable guide 45 serving as a direction changing member for changing a moving direction of raising-side cable 33 is provided in an upper end portion of guide rail 31.

As illustrated in FIGS. 1 to 4, drive section 35 for winding and unwinding raising-side cable 33 and lowering-side cable 34 is provided in a lower end portion of guide rail 31.

Drive section 35 includes drum housing 51, drum 55 (see FIG. 8), and drive motor 56.

Drum housing 51 is attached to a lower end portion of guide rail 31, and fixes guide rail 31 to a door panel of a vehicle (not illustrated) together with an upper bracket (not illustrated).

Figure 8:
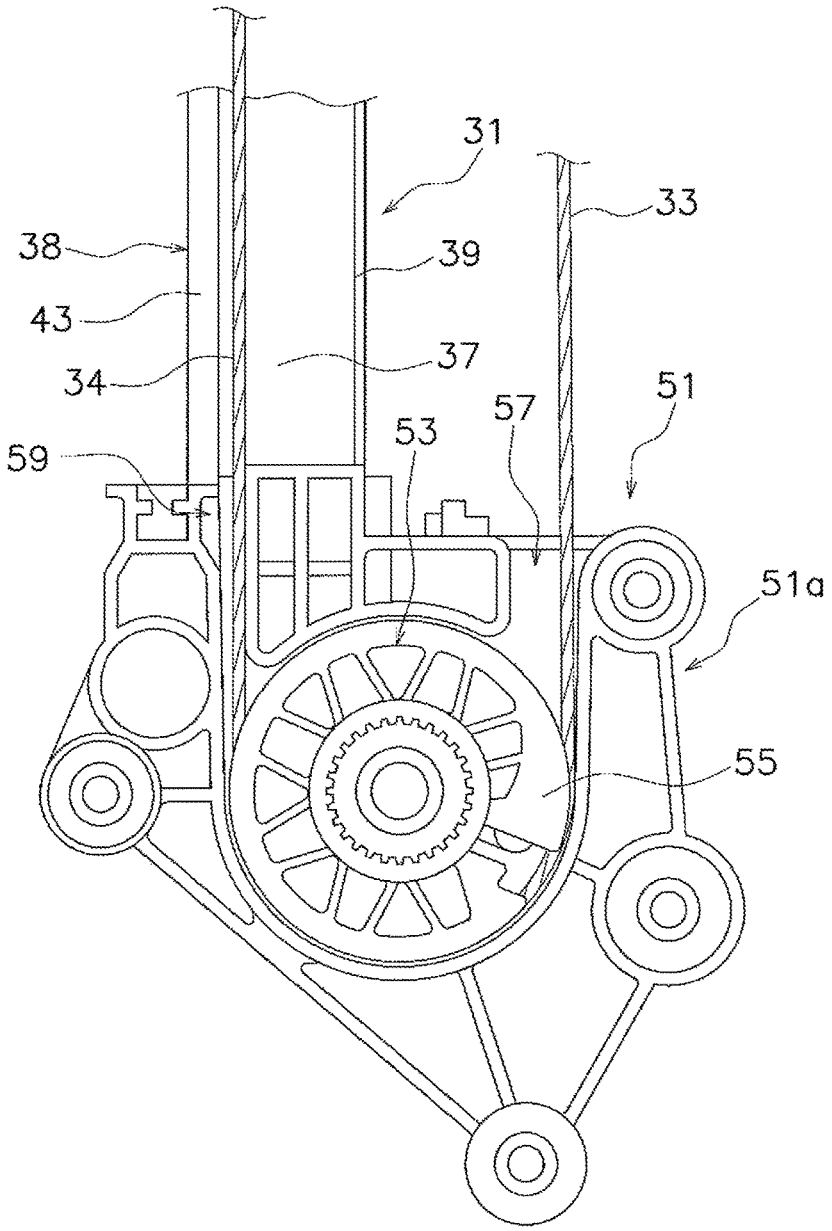
FIG. 8 is a partially-enlarged front view of the window regulator in FIG. 1, which illustrates a drum, a drum housing, raising and lowering wires, and a guide rail.
Figure 9:
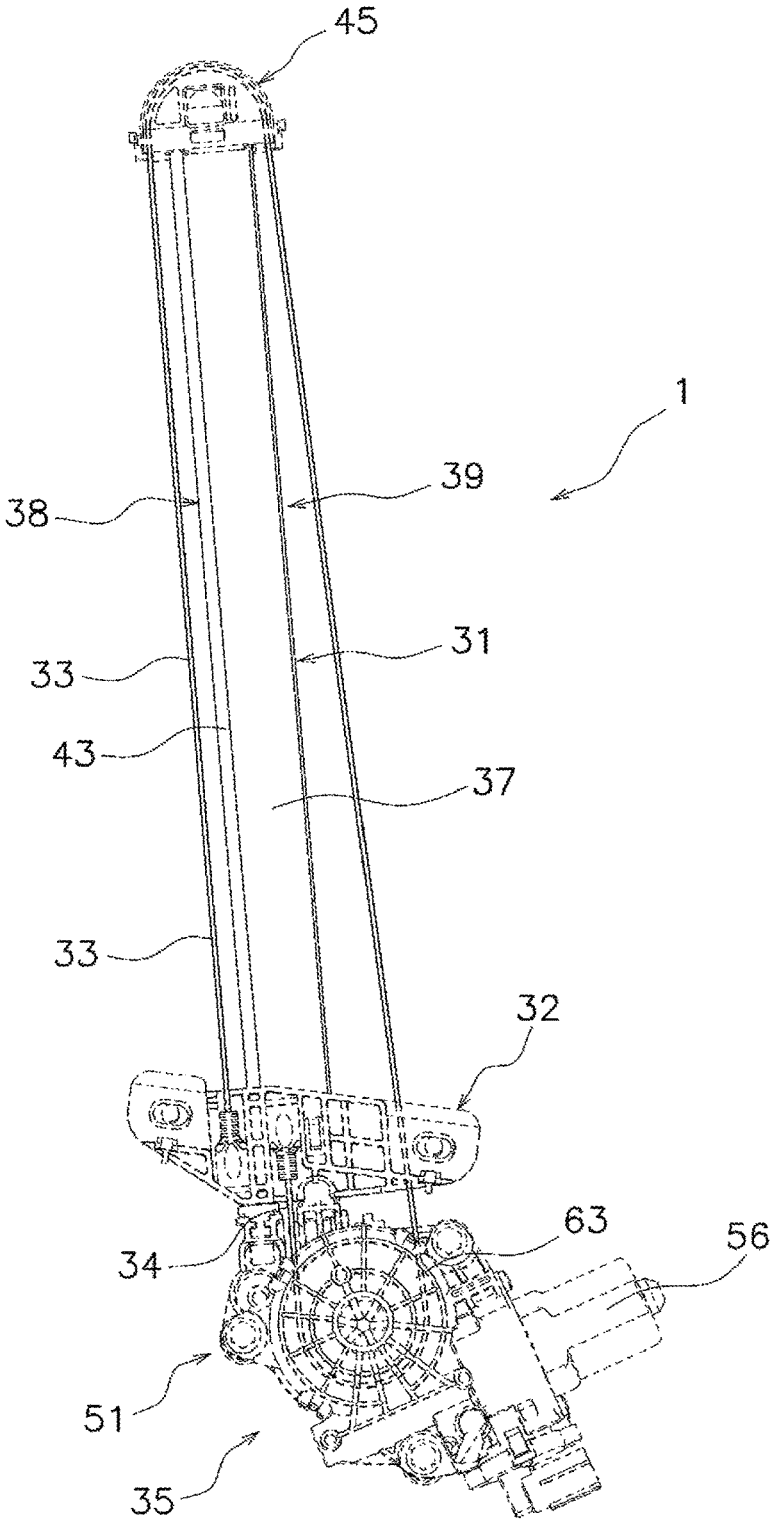
FIG. 9 is a front view of the window regulator (carrier plate is in a lower position)
Figure 10:
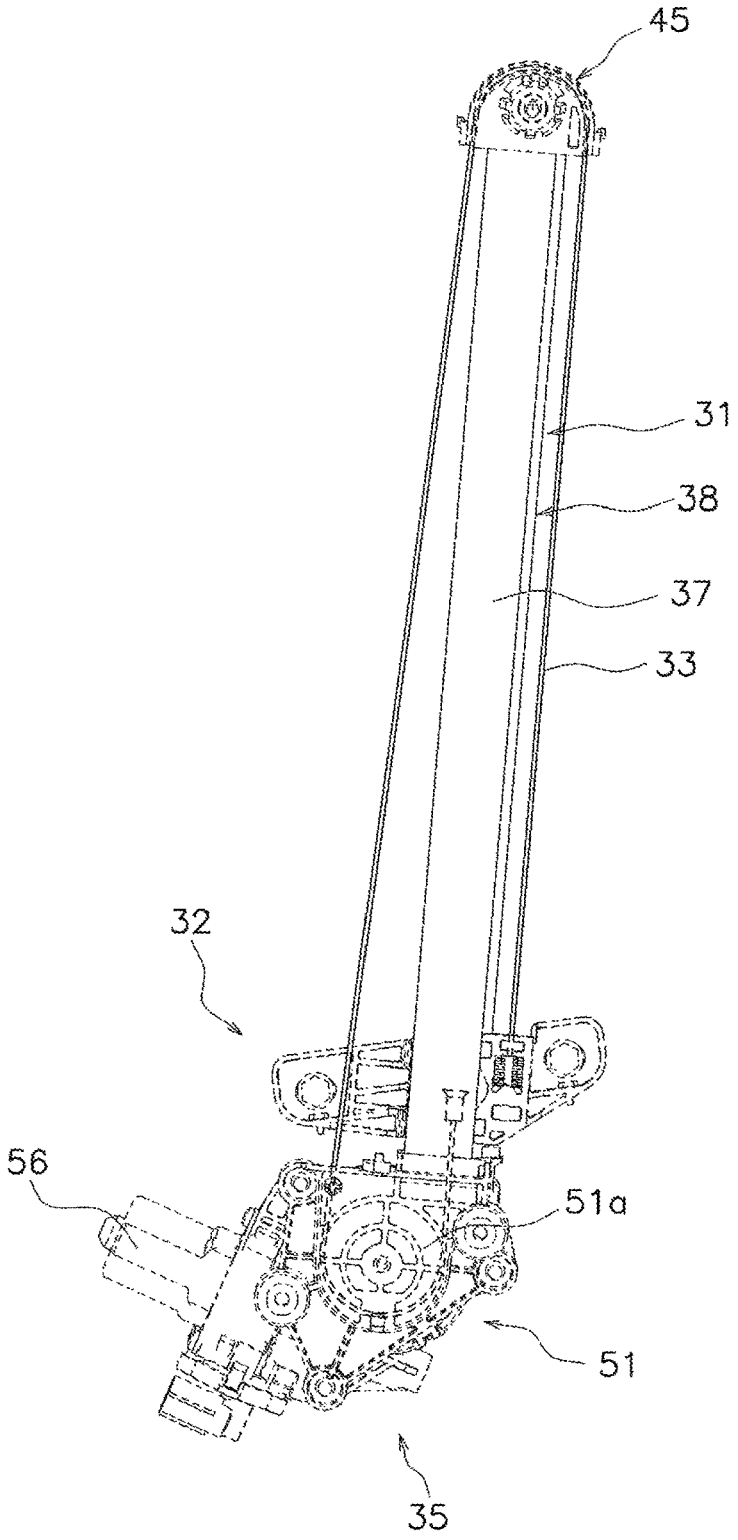
FIG. 10 is a rear view of the window regulator (carrier plate is in a lower position)
Figure 11:
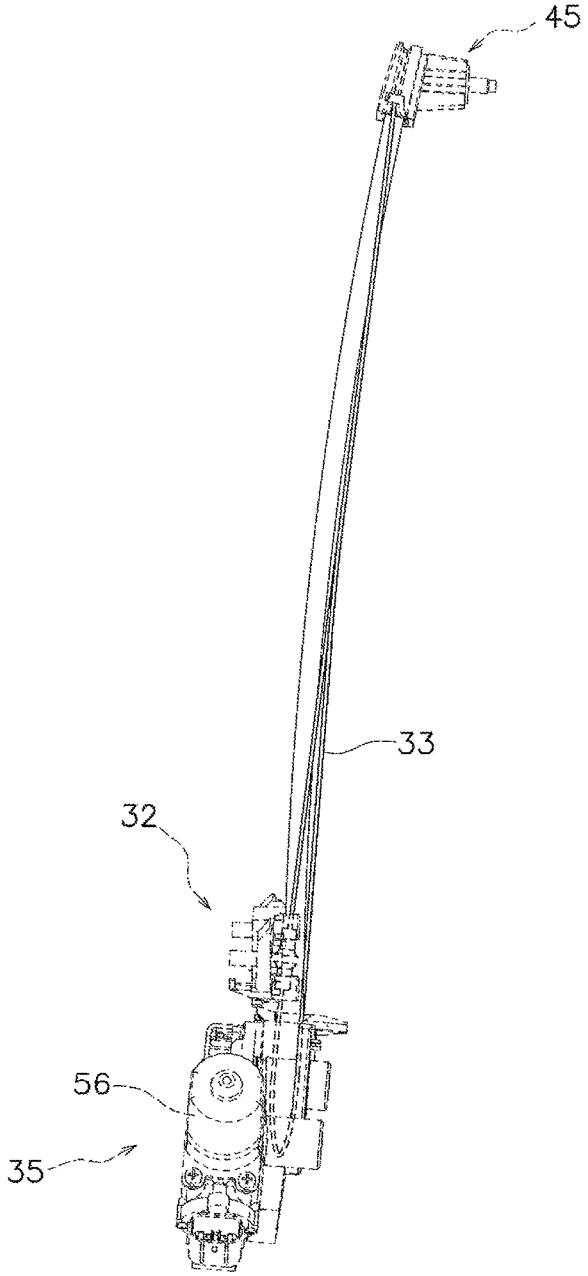
FIG. 11 is a side view of the window regulator (carrier plate is in a lower position)
Figure 12:
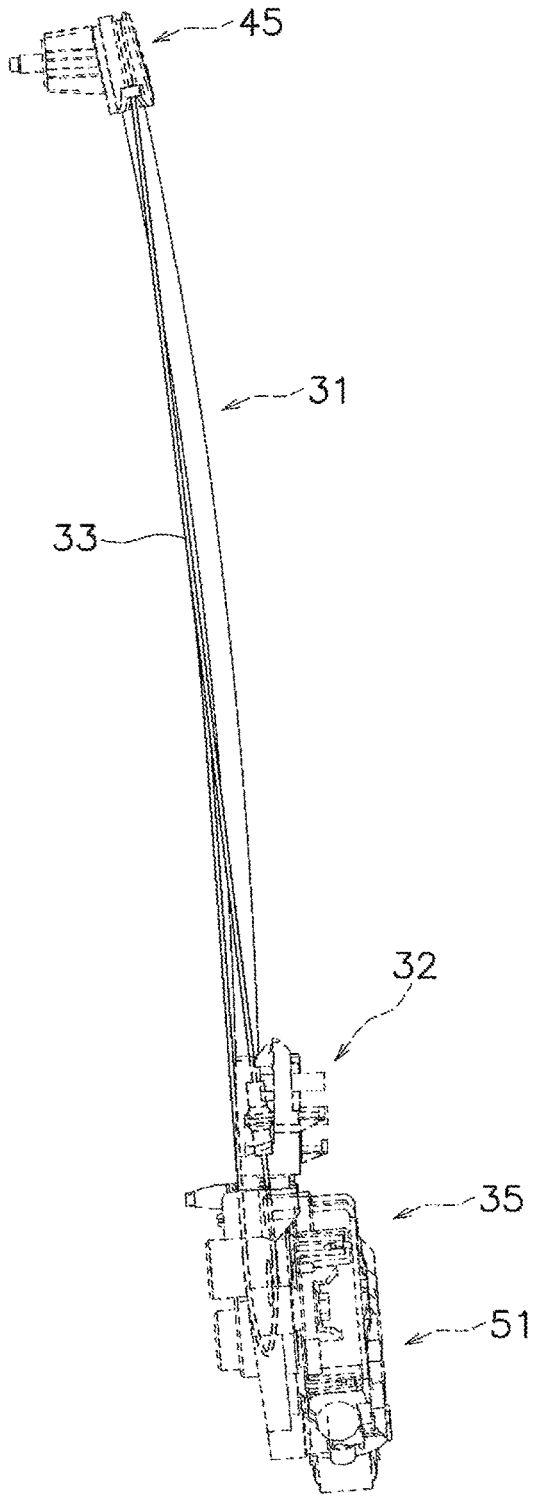
FIG. 12 is a side view of the window regulator (carrier plate is in a lower position)
Figure 13:
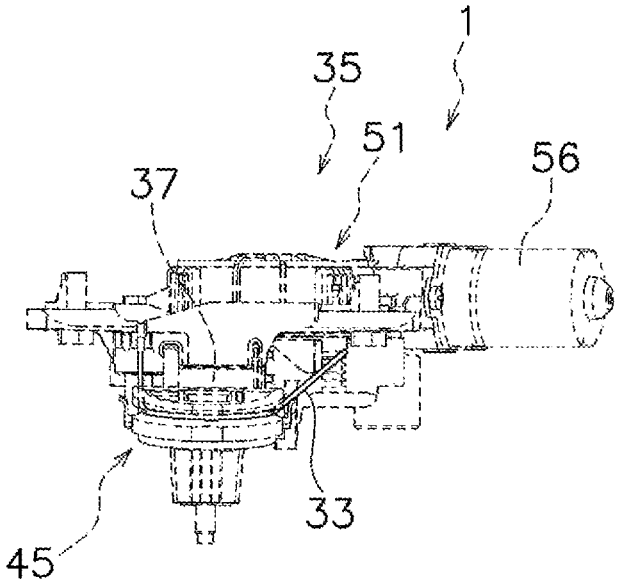
FIG. 13 is a plan view of the window regulator.
Figure 14:
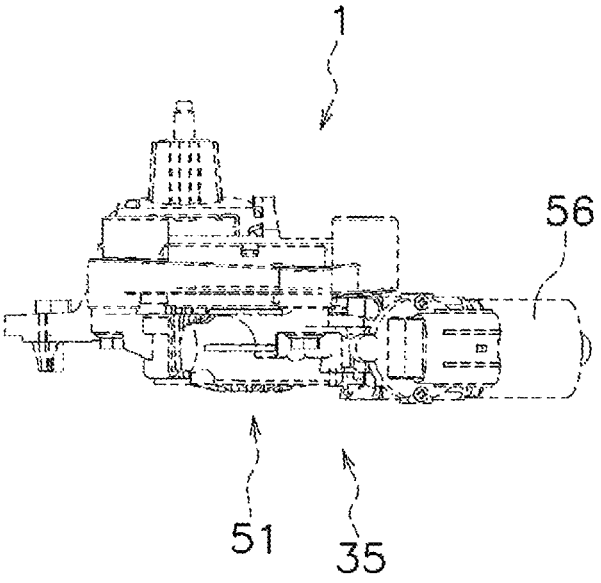
FIG. 14 is a bottom view of the window regulator.

As illustrated in FIG. 8, drum 55 is rotatably supported by drum housing 51, and an end of raising-side cable 33 and lowering-side cable 34 are connected to drum 55.

Drum 55 winds and unwinds raising-side cable 33 and lowering-side cable 34 by rotation.

Drive motor 56 is integrally attached to drum housing 51 and rotationally drives drum 55 in a forward-backward direction.

Raising-side cable 33 and lowering-side cable 34 are configured to pull carrier plate 32 in the up-down direction, and for each of these cables, a widely-known cable made by twining a plurality of metal wires or resin fiber wires can be used.

Raising-side cable 33 is connected to carrier plate 32 at one end of raising-side cable 33, wound on upper cable guide 45, and connected to drum 55 at the other end thereof. Lowering-side cable 34 is connected to carrier plate 32 at one end of lowering-side cable 34 and connected to drum 55 at the other end thereof. A connection structure of raising-side cable 33 and lowering-side cable 34 with carrier plate 32 will be described in detail, later.

(2) Guide Rail

Guide rail 31 extends substantially in an up-down direction of a vehicle. More specifically, guide rail 31 extends to a direction so as to incline slightly obliquely with respect to a glass which is attached to guide rail 31. Guide rail 31 gently curves so as to conform with curvature of window glass 20 of an automobile and thus to form a protrusion on a front side (vehicle interior side) of FIG. 1. Guide rail 31 is made of, for example, stainless steel, aluminum alloy, and/or another hard material.

Guide rail 31 includes guide-rail main body 37 serving as a bottom portion, first sidewall portion 38, and second sidewall portion 39. First and second sidewall portions 38 and 39 each erect from a long side of guide-rail main body 37 along a length direction of guide-rail main body 37 and together form a U-shape in a cross section intersecting the length direction of guide rail 31. Second sidewall portion 39 includes first portion 41 and second portion 43. First portion 41 erects so as to form a right angle with guide-rail main body 37 from guide-rail main body 37. Second portion 43 extends in a direction opposite to guide-rail main body 37 so as to form a right angle with first portion 41 at an end portion of first portion 41 on a side opposite to guide-rail main body 37. Second portion 43 extends in parallel with guide-rail main body 37 and extends outward in a width direction. The structure described above improves the strength of first sidewall portion 38.

First and second sidewall portions 38 and 39 extend along the length direction of guide-rail main body 37. However, as long as first and second sidewall portions 38 and 39 are provided along guide-rail main body 37 and have at least a length sufficient to allow carrier plate 32 to slide, for example, a structure without an upper end and/or a lower end may be employed.

(3) Drive Section

Figure 7:
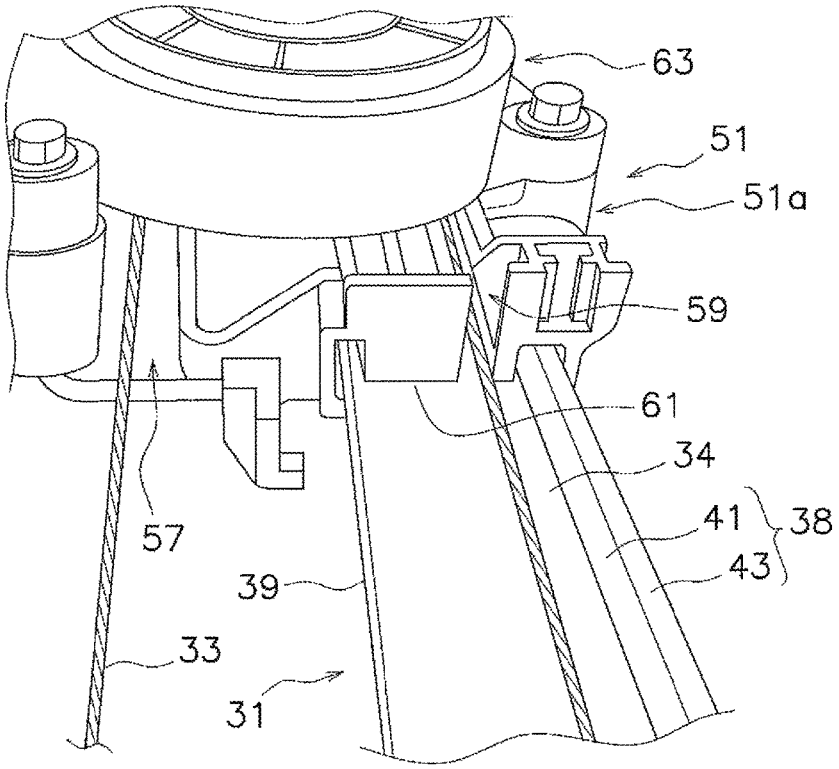
FIG. 7 is a perspective view illustrating a positional relationship between cable lead-out grooves and the guide rail.

As illustrated in FIGS. 7 and 8, drum housing 51 includes main body 51*a* which has a fitting portion with respect to the guide rail and a cylindrical drum-housing section. FIG. 7 is a perspective view illustrating a positional relationship between cable lead-out grooves and the guide rail. FIG. 8 is a partially-enlarged front view of the window regulator in FIG. 1, which illustrates a drum, a drum housing, raising and lowering wires, and a guide rail. In main body 51*a*, cylindrical-shape recess 53 housing drum 55 therein is formed. Raising-side cable lead-out groove 57 and lowering-side cable lead-out groove 59 are formed in main body 51*a*. Raising-side and lowering-side cable lead-out grooves 57 and 59 are provided respectively for allowing raising-side and lowering-side cables 33 and 34 to pass through from recess 53 to lead out raising-side and lowering-side cables 33 and 34 outside. Moreover, insertion hole 61 for fittingly fixing a lower end portion of guide rail 31 is formed on a top surface of a portion protruding leftward from an upper portion of main body 51*a*.

Drum 55 is rotatably held in recess 53. In an outer periphery of drum 55, a groove for guiding raising-side and lowering-side cables 33 and 34 is spirally formed, and a recess portion which rotatably fits with a support shaft (not illustrated) formed on a bottom surface of recess 53 of the drum housing is provided.

Note that, drum 55 is a cable hooking member on which lowering-side cable 34 is wound, and an outer diameter of drum 55 is larger than a width of guide rail 31. Accordingly, guide rail 31 is reduced in weight. Note that, the cable support member is not limited to drum 55, and any member that at least allows lowering-side cable 34 to be hooked thereon can be employed.

Drive motor 56 is an apparatus which rotationally drives a drum and is fixed to drum housing 51. Drive motor 56 includes a speed reducer (not illustrated), and recess 53 of drum housing 51 is covered by speed-reducer cover 63.

(4) Upper Cable Guide

Upper cable guide 45 is a direction changing member formed in a semi-circular shape as viewed from front, by using a synthetic resin material, and configured to change a moving direction of a cable so as to turn down the cable in motion, for example. Moreover, a guide groove (not illustrated) for guiding a cable in a sliding state is formed on a curved peripheral surface of upper cable guide 45. Upper cable guide 45 can be fastened using a bolt and/or the like to an upper bracket (not illustrated) used for fixing the upper end portion of guide rail 31 to a door panel of a vehicle, and can be integrally configured with the upper bracket.

In addition, upper cable guide 45 may be any member that changes the moving direction of raising-side cable 33, and for example, a pulley rotatably supported by the upper bracket which is attached to guide rail 31 or the upper end portion of guide rail 31 can be used.

(5) Carrier Plate

As illustrated in FIGS. 5 and 6, carrier plate 32 includes main body 32*a*, first guide groove 75, second guide groove 77, raising-side end holder 79, and lowering-side end holder 81. Main body 32*a* is a base body and can be any portion where another structure is formed.

First guide groove 75 and second guide groove 77 are grooves for sliding first sidewall portion 38 and second sidewall portion 39 of guide rail 31. As illustrated in FIG. 6, first and second guide grooves 75 and 77 are formed on a guide-rail-side surface of carrier plate 32. In this case, since first sidewall portion 38 has an L-shape composed of first portion 41 and second portion 43, a gap between first sidewall portion 38 and first guide groove 75 is small. Thus, rattling of carrier plate 32 is less likely to occur.

Note that, the engagement structure of guide rail 31 and carrier plate 32 can be any structure as long as carrier plate 32 can slide while carrier plate 32 is guided by guide rail 31. For example, a configuration can be employed in which a sliding groove is formed on a side of carrier plate 32, and an engagement protrusion which is engaged with the sliding groove is provided on a side of guide rail 31.

Raising-side end holder 79 is a structure for housing end 33*a* of raising-side cable 33. Raising-side end holder 79 is provided such that raising-side cable 33 is positioned on an outer side spaced from a guide rail. Lowering-side end holder 81 is a structure for housing end 34*a* of lowering-side cable 34. Lowering-side end holder 81 is provided so as to be positioned on or above guide rail 31 when carrier plate 32 is attached to guide rail 31. In addition, lowering-side end holder 81 is provided on carrier plate 32 such that lowering-side cable 34 is positioned on or above guide rail 31 when lowering-side cable 34 is wound on drum 55 and routed to window regulator 1. In other words, carrier plate 32 and drum housing 51 are attached to guide rail 31 such that a line connecting between lowering-side end holder 81 and lowering-side cable lead-out groove 59 is positioned above the guide rail. Note that, in this embodiment, raising-side end holder 79 and lowering-side end holder 81 have shapes that respectively cover side surfaces of end 33*a* and end 34*a*. Raising-side end holder 79 and lowering-side end holder 81 are, however, not particularly limited.

Ends 33*a* and 34*a* are, for example, formed by using die-casting of a metal material, and each include a base portion to which one end of raising-side cable 33 or lowering-side cable 34 is attached and a flange portion having an outer diameter larger than that of the base portion. The base portion is formed in a cylindrical shape or a conical trapezoidal shape, and one end of raising-side cable 33 or lowering-side cable 34 is fixed to the base portion by adhesion, welding, bolt stop, and/or another method.

First coil spring 85 and second coil spring 87 are each mounted to end 33*a* and end 34*a*, respectively. First and second coil springs 85 and 87 are energizing members which energize ends 33*a* and 34*a* in directions to eliminate looseness of raising-side and lowering-side cables 33 and 34, respectively.

(6) Positional Relationship

Guide rail 31 is shifted leftward with respect to drum 55 of drive section 35 in drawings when viewed in front. More specifically, when a virtual line is extended downward, guide rail 31 is shifted from rotation center of drum 55 as illustrated in FIGS. 1 and 8

Moreover, a width length of guide rail 31 is shorter than an outer diameter of drum 55. For this reason, raising-side cable 33 is disposed on both sides of guide rail 31 apart from guide rail 31.

Furthermore, guide rail 31 extends upward from drive section 35 while tilting obliquely leftward in FIG. 1. Accordingly, carrier plate 32 moves up and down obliquely along guide rail 31. For this reason, carrier plate 32 tilts in either one direction with respect to guide rail 31, and thus, a gap in each engagement portion between carrier plate 32 and guide rail 31 is made small. As a result, it is less likely that rattling between carrier plate 32 and guide rail 31 occurs.

Lowering-side end holder 81 of carrier plate 32 is positioned on or above guide rail 31.

Furthermore, as illustrated in FIGS. 7 and 8, lowering-side cable lead-out groove 59, which is a lead-out section for lowering-side cable 34 in drum 55, is positioned on or above guide rail 31. In this case, even in a case where the width of guide rail 31 is smaller than the outer diameter of drum 55, lowering-side cable 34 can be surely disposed on or above guide rail 31.

As described above, lowering-side cable 34 is disposed on or above guide rail 31 when carrier plate 32 is in a lower end position or a middle position.

(7) Movement

A description will be given of a movement which window glass 20 moves from a lowermost end position to an uppermost end position.

First, as illustrated in FIGS. 1 and 2, window glass 20 is in the lowermost end position. At this time, carrier plate 32 is in a position adjacent to an upper side of drive section 35. Accordingly, an unwound amount of raising-side cable 33 from drum 55 is largest, and an unwound amount of lowering-side cable 34 from drum 55 is smallest. When drive motor 56 rotationally drives drum 55, carrier plate 32 moves up and causes window glass 20 to move up accordingly.

FIG. 5 illustrates a state where carrier plate 32 moves up to a middle portion in a longitudinal direction of guide rail 31, for example. As apparent from FIG. 5, lowering-side cable 34 is positioned on or above guide rail 31 in planar view. In other words, lowering-side cable 34 is within a region in the width direction of guide rail 31.

Finally, window glass 20 reaches an upper-end restraint position as illustrated in FIGS. 3 and 4. At this time, carrier plate 32 is in a position adjacent to a lower side of upper cable guide 45.

Moreover, when carrier plate 32 is at least in the upper-end restraint position with respect to guide rail 31, lowering-side cable 34 is in contact with guide rail 31. More specifically, lowering-side cable 34 is partly or mostly in contact with guide-rail main body 37 of guide rail 31.

In window regulator 1 described thus far, since lowering-side cable 34 is disposed on or above guide rail 31, lowering-side cable 34 easily slides with respect to guide rail 31 when carrier plate 32 moves up and lowering-side cable 34 is unwound. Accordingly, lowering-side cable 34 comes into contact with guide rail 31, and because of the contact state, vibration of lowering-side cable 34 is suppressed, and thus, noise which is caused by the vibration of lowering-side cable 34 is suppressed.

Note that, in this embodiment, guide rail 31 curves so as to protrude in a direction in which a trajectory of up and down movement of window glass 20 is to be positioned, or in a direction of a position in which lowering-side cable 34 is routed. Accordingly, at the point where window glass 20 reaches a middle portion in the longitudinal direction, lowering-side cable 34 starts coming into contact with a surface of guide rail 31. It is, however, possible to employ a configuration in which lowering-side cable 34 starts coming into contact with guide rail 31 when carrier plate 32 reaches near an upper end position with respect to guide rail 31 (i.e., an upper limit position in a range where carrier plate 32 can actually move, by restraint of window glass 20 and/or the like, or a position near this upper limit position). This is because since lowering-side cable 34 is most unwound in length and most easily vibrates when carrier plate 32 is near the upper end position, suppressing vibration of lowering-side cable 34 at this time is effective for noise prevention.

(8) Other Embodiments and/or the Like

An embodiment of the present invention has been described thus far, but this invention is not limited to the embodiment described above, and various modifications are possible within a range not departing from the gist of the invention. In particular, a plurality of embodiments and variations described in this specification can be optionally combined as appropriate.

Note that, a primary part of a design in the drawings of the embodiment described above is a positional relationship between the guide rail, and the raising-side and lowering-side cables. More specifically, when the carrier plate is in a lower end position or a middle position of the guide rail, the raising-side cable is disposed on both sides of the guide rail apart from the guide rail in a front view and a rear view, and the lowering-side cable is disposed on or above the guide rail in the rear view. In other words, in this window regulator, as illustrated in FIGS. 9 to 14, portions denoted by solid lines are portions having characteristics as an appearance this window regulator, and rights are sought for these characteristic portions.

INDUSTRIAL APPLICABILITY

The present invention is applicable to a window regulator which drives a window glass of an automobile up and down.

REFERENCE SIGNS LIST

1 Window regulator
20 Window glass
31 Guide rail
32 Carrier plate
32*a* Main body
33 Raising-side cable
33*a* End
34 Lowering-side cable
34*a* End
35 Drive section
37 Guide-rail main body
38 First sidewall portion
39 Second sidewall portion
41 First portion
43 Second portion
45 Upper cable guide
51 Drum housing
51*a* Main body
53 Recess
55 Drum
56 Drive motor
57 Raising-side cable lead-out groove
59 Lowering-side cable lead-out groove
61 Insertion hole
63 Speed-reducer cover
71 Main body
75 First guide groove
77 Second guide groove
79 Raising-side end holder
81 Lowering-side end holder

The invention claimed is:

1. A window regulator comprising:
a guide rail,
a carrier plate,
a raising-side cable, and
a lowering-side cable,
wherein the carrier plate includes:
a raising-side end holder which houses an end of the raising-side cable, and
a lowering-side end holder which houses an end of the lowering-side cable, and
wherein:
the raising-side end holder is provided such that the raising-side cable is positioned outside the guide rail,
the lowering-side end holder is provided such that the lowering-side cable is positioned on or above the guide rail,
the carrier plate is configured to move up and down along an edge of the guide rail when the carrier plate moves up and down, and
the guide rail has a curved shape such that the lowering-side cable is in contact with the guide rail when the carrier plate is positioned at least near an upper end with respect to the guide rail.

2. The window regulator according to claim 1, further comprising
a cable hooking member on which the lowering-side cable is to be wound, wherein the guild rail has a width smaller than an outer diameter of the cable hooking member.

3. The window regulator according to claim 2, wherein a lead-out section for the lowering-side cable in the cable hooking member is positioned on or above the guide rail.

* * * * *